US005520111A

United States Patent [19]

Hirose

[11] Patent Number: 5,520,111

[45] Date of Patent: May 28, 1996

[54] PLATE EXCHANGE APPARATUS FOR PRINTING PRESS

[75] Inventor: Norio Hirose, Ibaraki, Japan

[73] Assignee: Komori Corporation, Japan

[21] Appl. No.: 344,521

[22] Filed: Nov. 23, 1994

Related U.S. Application Data

[63] Continuation of Ser. No. 162,838, Dec. 3, 1993, abandoned, which is a continuation of Ser. No. 894,523, Jun. 5, 1992, abandoned.

[30] Foreign Application Priority Data

Jun. 19, 1991 [JP] Japan ..... 3-173387

[51] Int. Cl.[6] ..... B41F 27/12

[52] U.S. Cl. ..... 101/477; 101/415.1

[58] Field of Search ..... 101/216, 415.1, 101/477, DIG. 36; 74/89.17

[56] References Cited

U.S. PATENT DOCUMENTS

| | | | |
|---|---|---|---|
| 3,148,571 | 9/1964 | Wallis | 74/89.17 |
| 3,395,379 | 7/1968 | Haggard | 74/89.17 |
| 4,408,530 | 10/1983 | Yano et al. | 101/DIG. 36 |
| 4,479,841 | 10/1984 | Rapp et al. | 101/DIG. 36 |
| 4,517,893 | 5/1985 | Wile et al. | 101/126 |
| 4,528,906 | 7/1985 | Hasegawa | 101/415.1 |
| 5,127,322 | 7/1992 | Kobler | 101/DIG. 36 |

FOREIGN PATENT DOCUMENTS

| | | | |
|---|---|---|---|
| 431715 | 6/1991 | European Pat. Off. | 101/415.1 |

*Primary Examiner*—Stephen Funk
*Attorney, Agent, or Firm*—Blakely, Sokoloff, Taylor & Zafman

[57] ABSTRACT

A plate exchange apparatus for a printing press includes a plate holding unit, a rack, a pinion, and a driving unit. The plate holding unit is supported on a frame to be vertically movable and holds at least one of a plate discharged from a plate cylinder and a plate to be supplied to the plate cylinder. The rack is fixed on the plate holding unit to extend in a vertical direction. The pinion is mounted on the frame to mesh with the rack. The driving unit is mounted on the frame to rotate the pinion.

2 Claims, 3 Drawing Sheets

PLATE EXCHANGE APPARATUS FOR PRINTING PRESS

This is a continuation of application Ser. No. 08/162,838, filed Dec. 3, 1993, now abandoned, which is a continuation of Ser. No. 07/894,523, filed Jun. 5, 1992, now abandoned.

BACKGROUND OF THE INVENTION

The present invention relates to a plate exchange apparatus for a printing press, which exchanges an old plate gripped by plate lockup devices and mounted on the circumferential surface of a plate cylinder for a new plate prepared outside the apparatus.

A gap having a length almost equal to the overall length of a plate cylinder is formed in the circumferential surface of the plate cylinder for a printing press. A plate lockup apparatus consisting of a leading-side lockup device for gripping the leading end of a plate and a trailing-side lockup device for gripping the trailing end of the plate, the leading end of the plate being gripped by the leading-side lockup device while the plate is wound around the circumferential surface of the plate cylinder, is fixed on the bottom surface of the gap to extend in the axial direction of the plate cylinder. Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table by being opened or closed as they swing, and a plurality of cams which can be respectively engaged with notches at the edges of the gripper plates. The plurality of cams are aligned along a pivotal cam shaft. A plurality of compression coil springs are interposed between the lockup table and the gripper plates to bias the gripper plates in an open direction.

With the above arrangement, in order to grip a plate, when the cam shaft is pivoted, the gripper plates are released upon disengagement from the cams and are opened by the elastic forces of the compression coil springs. An end of the plate is inserted between the gripper plates and the corresponding lockup table. When the cam shaft is pivoted in the direction opposite to the direction described above, the gripper plates are pivoted against the elastic forces of the compression coil springs by the behavior of the cams and closed, thereby gripping the end of the plate.

However, in the conventional plate lockup apparatus as described above, the cam shaft must be manually rotated in order to open and close the plate gripper surfaces, as described above. Therefore, the number of processing steps is increased to degrade the operability, resulting in need for much labor, and the preparation time is prolonged to degrade the operating efficiency of the printing press.

The present applicant developed and proposed a plate exchange apparatus in which a plate holding member holding a new plate is provided between units of the printing press, an old plate removed from the plate cylinder is discharged to and held in the plate holding member, and the new plate is discharged from the plate holding member and mounted on the plate cylinder. In this case, however, when the plate holding unit stores a plate, the lower half portion of the holding member is located at a position to cover a dampening arrangement of the printing unit. Thus, when maintenance/inspection of the dampening arrangement or replenishment of dampening water in a dampening water fountain is to be performed, the plate holding member interferes with the operation to degrade the operability and to cause a great danger. However, much labor is needed to manually remove the plate holding unit having a large weight from the maintenance work surface every time an inspection operation or the like is to be performed or to restore the plate holding unit to the initial position after the operation. Furthermore, since the plate holding unit having a precise arrangement must be moved with care, the operation requires a long period of time to prolong the preparation time, thus degrading the operating efficiency of the printing press.

SUMMARY OF THE INVENTION

It is, therefore, an object of the present invention to provide a plate exchange apparatus for a printing press, in which the operability and safety in maintenance/inspection or the like are improved.

It is another object of the present invention to provide a plate exchange apparatus for a printing press, in which the time required by the maintenance/inspection operation is shortened to improve the operating efficiency of the printing press.

In order to achieve the above objects, according to the present invention, there is provided a plate exchange apparatus for a printing press, comprising a plate holding unit, supported on a frame to be vertically movable, for holding at least one of a plate discharged from a plate cylinder and a plate to be supplied to the plate cylinder, a rack fixed on the plate holding unit to extend in a vertical direction, a pinion, mounted on the frame, for meshing with the rack, and a driving unit, mounted on the frame, for driving to rotate the pinion.

DETAILED DESCRIPTION OF THE PREFERRED EMBODIMENT

Figure 1:
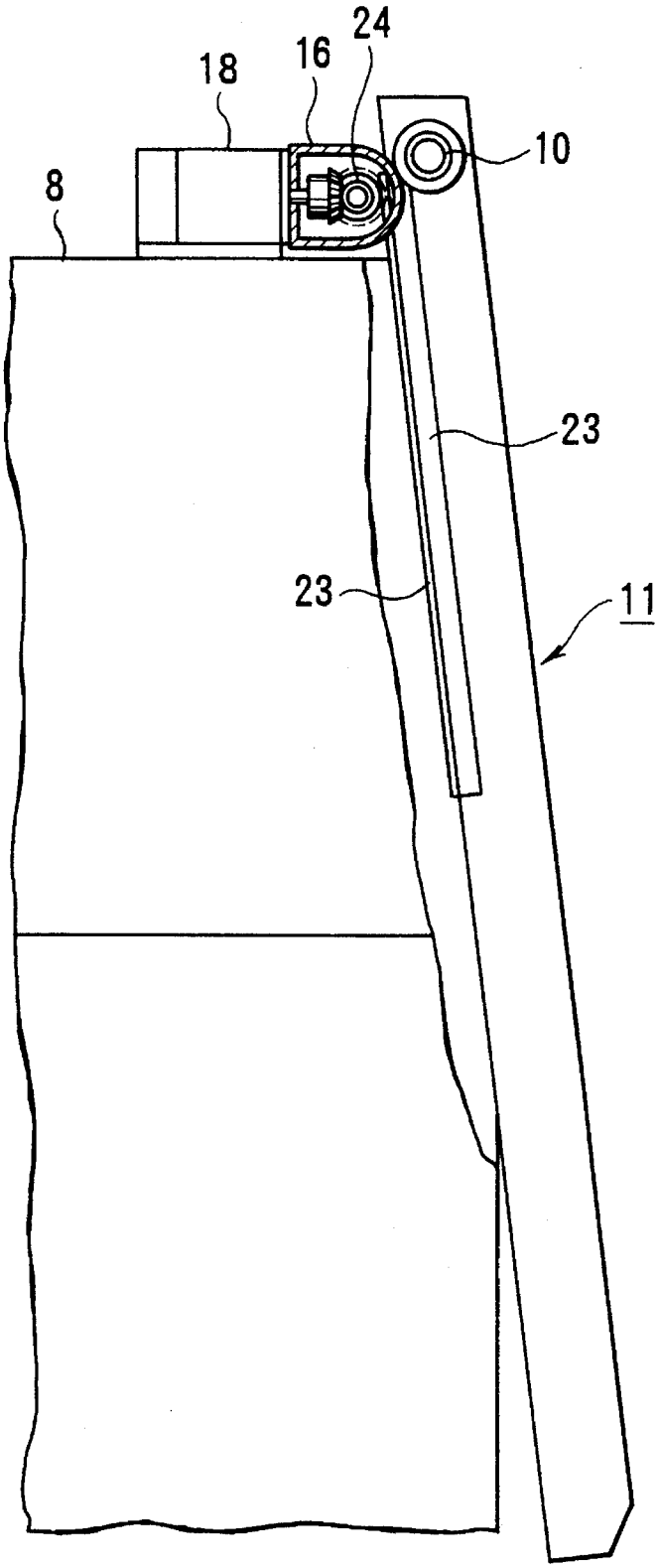
FIG. 1 is a front view showing an arrangement of a plate holding unit and a driving unit for vertically moving the plate holding unit that constitute a plate exchange apparatus according to an embodiment of the present invention.
Figure 2:
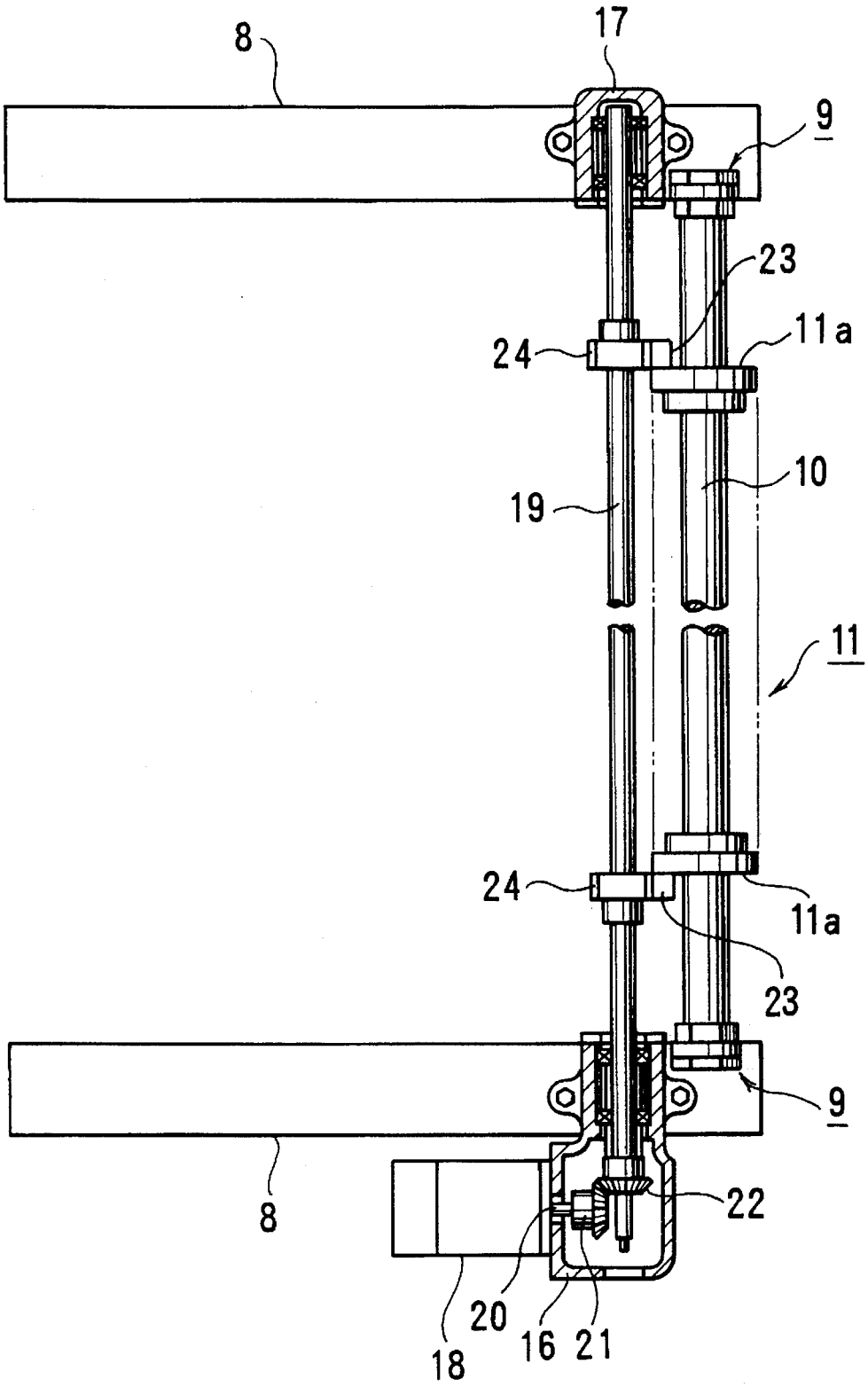
FIG. 2 is a partially cutaway plan view showing the arrangement of the plate holding unit and the driving unit for vertically moving the plate holding unit that constitute the plate exchange apparatus according to the embodiment of the present invention.
Figure 3:
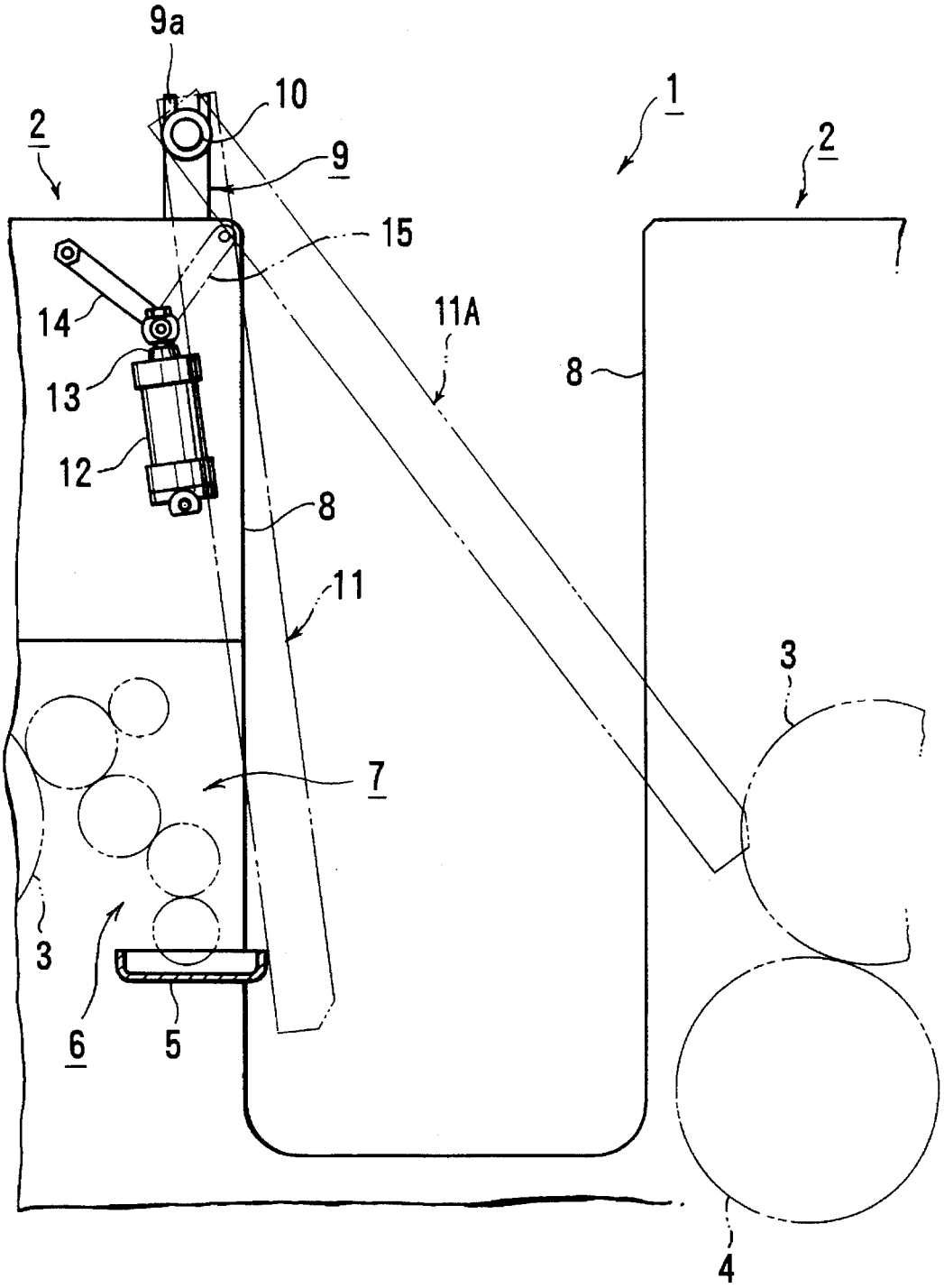
FIG. 3 is a schematic front view of the plate exchange apparatus according to the present invention.

FIGS. 1 to 3 show a plate exchange apparatus for a sheet printing press according to the present invention.

Referring to FIG. 3, a printing press 1 comprises a paper feed unit (not shown) for feeding sheets stacked on a paper stacker one by one, four printing units 2, and a paper discharge unit (not shown) having a paper stacker for stacking thereon a printed matter printed by the printing units 2. Each printing unit 2 comprises printing cylinders, e.g., a plate cylinder 3 and a blanket cylinder 4, an inking unit (not shown), and a dampening arrangement 7 constituted by a dampening water fountain 5, a roller group 6, and the like. A leading-side plate lockup device for gripping one end of a plate and a trailing-side plate lockup device for gripping the other end of the plate are provided in a gap formed in the circumferential surface of the plate cylinder 3 to be capable of being opened and closed. One end of the plate is gripped by the leading-side plate lockup device, the plate is wound around the circumferential surface of the plate cylinder 3, and the other end of the plate is gripped by the trailing-side plate lockup device, thereby mounting the plate on the plate cylinder 3.

Each printing unit 2 additionally includes a plate exchange apparatus for exchanging an old plate for a new plate to be used next. More specifically, a pair of right and left brackets 9 are fixed on the upper end faces of frames 8 of each of the second-, third-, and fourth-color printing units 2, and on the upper end faces of the frames (not shown) provided at a paper discharge unit start portion to be spaced apart from the frames 8 of the fourth-color printing unit 2 such that they are located obliquely above the corresponding plate cylinder 3. U-shaped bearing grooves **9*a* which are open upward are formed in the brackets 9. Two end portions of a loader shaft 10 are pivotally and slidably fitted in the bearing grooves 9*a*, and a laterally rectangular loader 11, having almost the same length as that of the plate cylinder 3 when seen from the front and serving as a plate holding member, is fixed to the loader shaft 10 at its proximal end portion. A plate discharge unit is provided in the loader 11. When the loader 11 is set in the tilted state indicated by reference numeral 11A in FIG. 3, the leading- and trailing-side plate lockup devices are opened and closed, and the plate cylinder 3 is rotated, the old plate discharged from the plate cylinder 3 is moved forward into and held in the loader 11A. A plate supply unit is also provided in the loader 11A to mount a new plate, held in the loader 11A in advance, on the plate cylinder 3** in an order almost reverse to that during plate discharge.

Air cylinders 12 connected to a control unit are pivotally supported on the right and left frames 8 (including the frames provided at the start portion of the paper discharge unit) close to the brackets 9 to be swingable. Levers 14 pivotally supported on the frames 8 and levers 15 pivotally detachably supported on the loader 11 are pivotally mounted on the operation ends of piston rods 13 of the air cylinders 12. With this arrangement, when the piston rods 13 of the air cylinders 12 are moved forward and backward, the loader 11 is caused to swing, through the levers 14 and 15, between a storing position of the pendent state indicated by reference numeral 11 in FIG. 3 and an operative position of the tilted state indicated by reference numeral 11A in FIG. 3, so that the distal end portion of the loader 11 is moved apart from or close to the circumferential surface of the plate cylinder 3.

The apparatus has a unit for opening the work surface in front of the dampening arrangement 7 by moving the loader 11 upward, which is the characteristic feature of the present invention. More specifically, casings 16 and 17 are fixed on the front surfaces of the right and left frames 8, and a motor 18 which rotates at a low speed is mounted on the casing 16. Two end portions of a driving shaft 19 are pivotally supported on the bearings fitted in the right and left casings 16 and 17, and bevel gears 21 and 22 which mesh with each other are pivotally mounted on a motor shaft 20 and the driving shaft 19, respectively, that extend into the casing 16. Vertically extending racks 23 are fixed on right and left side boards **11*a* of the loader 11, and pinions 24 meshing with the racks 23 are pivotally mounted on the driving shaft 19. With this arrangement, when the motor 18 is operated from the state shown in FIG. 1 to drive the driving shaft 19 through the bevel gears 21 and 22, the loader 11 is moved upward by the engagement of the pinions 24 and the racks 23 to open the work surface in front of the dampening arrangement 7. When the motor 18 is rotated in the reverse direction, the loader 11 is moved downward to the position indicated in FIG. 1. Although not shown, a guide member, e.g., a guide roller for regulating the lateral movement of the loader shaft 10 and guiding the vertical movement of the loader shaft 10 is provided on the frame 8**.

The operation of the plate exchange apparatus having the arrangement as described above will be described. During the printing operation, the loader 11 is stored in the pendent state as indicated by reference numeral 11 in FIGS. 1 and 3, and a new plate to be used next is held in the loader 11.

After the printing operation is completed, when the old plate is to be exchanged for the new plate, a start button is depressed. Then, the air cylinders 12 are actuated to tilt the loader 11 to the plate exchange position, as indicated by reference numeral 11A in FIG. 3, through the levers 14 and 15. Also, e.g., a servo motor is driven to rotate the plate cylinder 3 through a predetermined angle to reach a plate discharge position. At this time, when the right and left air cylinders 12 are simultaneously actuated, the plate gripper surface of the trailing-side plate lockup device is opened, and the released old plate is discharged into and stored in the loader 11A by the rotation of the plate cylinder 3 and the operation of the plate discharge unit in the loader 11A. Subsequently, the new plate held in the loader 11A in advance is mounted on the plate cylinder 3 by the rotation of the plate cylinder 3, the opening and closing operations of the plate lockup devices, and the operation of the plate supply unit in the loader 11A. After the plate exchange operation, the loader 11A is set in the pendent state, and the operator enters the space between the units to remove the old plate in the loader 11 and to set a next new plate in the loader 11.

When maintenance/inspection of the dampening arrangement 7 is to be performed or when the dampening water is to be supplied to the dampening water fountain 5, the levers 14 are released from the loader 11, and the motor 18 is driven by operating a push button or the like. Then, the driving shaft 19 is rotated through the bevel gears 21 and 22, and the loader shaft 10 and the loader 11 are integrally moved upward by the engagement of the pinions 24 and the racks 23 while they are guided by the guide roller or the like. As a result, the work surface in front of the dampening arrangement 7 is fully open, so that maintenance/inspection or the like of the dampening arrangement 7 can be easily performed. Since the motor 18 is used as the driving unit, the opening/closing speed of the loader 11 can be arbitrarily set when compared to a case in which a spring member is used, and the loader 11 can be stopped at an arbitrary open position as required. In addition, if a solenoid brake is provided to the motor 18, the loader 11 will be prevented from abruptly moving downward to ensure safety.

In this embodiment, the motor 18 is used as the driving unit to vertically move the loader 11. However, an air cylinder, a rotary actuator, or the like can be used instead. The plate holding unit may hold either the plate discharged from the plate cylinder or the plate to be supplied to the plate cylinder, or may hold both.

As has been apparent from the above description, according to the present invention, in the plate exchange apparatus for a printing press, the plate holding unit for holding at least one of the plate discharged from the plate cylinder or the plate to be supplied to the plate cylinder is supported to be vertically movable, the racks are fixed on the plate holding unit, and the pinions on the frames which mesh with the racks are driven by the driving unit. Hence, to perform maintenance/inspection of the dampening arrangement or to supply dampening water, the plate holding unit can be moved upward only by operating a push button or the like to fully open the work surface for the maintenance/inspection operation. As a result, the labor needed for opening the work surface is decreased to improve the operability, and the safety is improved since the plate holding unit at the upward position will not accidentally fall. In addition, the maintenance operation or the like of the dampening arrangement is facilitated to shorten the preparation time, thus improving the operating efficiency of the printing press.

What is claimed is:

1. A plate exchange apparatus for a printing press, said plate exchange apparatus comprising:

a frame which supports at least one plate cylinder with a circumferential surface;

a plate holding unit, wherein the plate holding unit is supported on the frame, further wherein the plate holding unit has a support shaft pivotally supported on the frame so that the plate holding unit moves between an actuation position where a distal end portion is proximate to the plate cylinder and a stored position where the distal end portion is distant from the plate cylinder;

an actuating means for moving said distal end of the plate holding unit to and from the circumferential surface of the plate cylinder, said plate cylinder being fixedly held in the frame, the plate holding unit holding at least one of a plate discharged from the plate cylinder and a plate to be supplied to the plate cylinder;

a plurality of racks mounted on a right and left side of the plate holding unit and extending along a vertical direction of the plate holding unit;

at least one pinion coupled to the frame for meshing with said racks upon rotation of the pinion; and a operable driving unit for selectively providing an upward and downward movement of said plate holding unit when said plate holding unit is found in said stored position, said operable driving unit being coupled to the pinion, said operable driving unit rotating the pinion so that said pinion engages said racks and causes said upward and downward movement of said plate holding unit.

2. An apparatus according to claim 1, wherein the driving unit is a motor.

* * * * *